US011896878B2

(12) United States Patent
Sundquist et al.

(10) Patent No.: US 11,896,878 B2
(45) Date of Patent: Feb. 13, 2024

(54) COMPUTER TRACKABLE FOOTBALL, SYSTEM AND METHOD OF MANUFACTURING

(71) Applicant: Sports Virtual Training Systems Inc., Colorado Springs, CO (US)

(72) Inventors: Ted Sundquist, Parker, CO (US); William Jacob Harris, Littleton, CO (US); Benjamin J. Kwitek, Canon City, CO (US); Matthew Feigenbaum, Peyton, CO (US); Cody Schauer, Colorado Springs, CO (US); Taj Ford, Colorado Springs, CO (US); Noah Rogers, Yucaipa, CA (US); Vishnu Chatari, Colorado Springs, CO (US); Andrew Essex, Colorado Springs, CO (US); Kamil Kieszkowski, Denver, CO (US); Nicholas Autobee, Denver, CO (US)

(73) Assignee: SPORTS VIRTUAL TRAINING SYSTEMS, INC., Columbia, MO (US)

( * ) Notice: Subject to any disclaimer, the term of this patent is extended or adjusted under 35 U.S.C. 154(b) by 0 days.

(21) Appl. No.: 17/646,202

(22) Filed: Dec. 28, 2021

(65) Prior Publication Data

US 2022/0203177 A1 Jun. 30, 2022

Related U.S. Application Data

(60) Provisional application No. 63/132,759, filed on Dec. 31, 2020.

(51) Int. Cl.

| | |
|---|---|
| ***A63B 43/06*** | (2006.01) |
| ***A63B 43/00*** | (2006.01) |
| *A63B 24/00* | (2006.01) |

(52) U.S. Cl.

CPC ..... *A63B 43/06* (2013.01); *A63B 43/002* (2013.01); *A63B 2024/0028* (2013.01); *A63B 2225/74* (2020.08); *A63B 2243/007* (2013.01)

(58) Field of Classification Search

CPC ... A63B 43/06; A63B 43/002; A63B 2225/74; A63B 2243/007; A63B 41/02

See application file for complete search history.

(56) References Cited

U.S. PATENT DOCUMENTS

| | | | | |
|---|---|---|---|---|
| 4,148,096 | A * | 4/1979 | Haas | A63B 43/06 362/249.14 |
| 10,943,501 | B2 | 3/2021 | Sundquist et al. | |
| 10,944,226 | B2 * | 3/2021 | Justin | H01R 31/06 |
| 2005/0067628 | A1 * | 3/2005 | Kuwabara | H01L 33/60 257/E33.072 |
| 2008/0076271 | A1 * | 3/2008 | Chang | H01R 11/282 439/39 |
| 2008/0192458 | A1 * | 8/2008 | Li | G02B 6/005 313/498 |
| 2011/0218065 | A1 * | 9/2011 | Cavallaro | A63B 41/00 473/603 |

(Continued)

*Primary Examiner* — Steven B Wong

(74) *Attorney, Agent, or Firm* — Welsh Flaxman & Gitler LLC

(57) ABSTRACT

A ball includes a ball body and a light system including integrated infrared (IR) light-emitting-diodes (LEDs). In accordance with a disclosed embodiment, the ball is a football and is adapted for use in conjunction with virtual reality (VR) systems.

17 Claims, 6 Drawing Sheets

FIG. 6

(56) References Cited

U.S. PATENT DOCUMENTS

| | | | | |
|---|---|---|---|---|
| 2012/0157246 | A1* | 6/2012 | Glover | A63B 69/00 473/570 |
| 2012/0244969 | A1* | 9/2012 | Binder | A63H 29/22 473/570 |
| 2013/0049681 | A1* | 2/2013 | Lu | H02J 7/0031 320/108 |
| 2014/0200103 | A1* | 7/2014 | Thurman | A63B 43/00 473/570 |
| 2014/0309059 | A1* | 10/2014 | Minch | A63B 69/0053 473/422 |
| 2015/0159846 | A1* | 6/2015 | Hollinger | F21V 33/008 362/183 |
| 2015/0176784 | A1* | 6/2015 | Hu | H04B 5/0037 315/76 |
| 2015/0219294 | A1* | 8/2015 | Sreshta | F21V 3/0625 362/96 |
| 2015/0246266 | A1* | 9/2015 | Zawitz | A63H 33/22 473/612 |
| 2016/0187969 | A1* | 6/2016 | Larsen | A63F 13/26 345/156 |
| 2017/0232305 | A1* | 8/2017 | Karabed | A63B 43/004 473/570 |
| 2018/0147455 | A1* | 5/2018 | Lee | A63B 43/004 |
| 2018/0161656 | A1* | 6/2018 | Koo | A63B 57/20 |
| 2020/0139203 | A1* | 5/2020 | Lin | A63B 43/06 |
| 2021/0166574 | A1 | 6/2021 | Sundquist et al. | |

* cited by examiner

COMPUTER TRACKABLE FOOTBALL, SYSTEM AND METHOD OF MANUFACTURING

CROSS REFERENCE TO RELATED APPLICATION

This application claims the benefit of U.S. Provisional Patent Application Ser. No. 63/132,759, filed Dec. 31, 2020, entitled "Computer Trackable Football System and Method of Manufacture," which is incorporated herein by reference.

BACKGROUND OF THE INVENTION

1. Field of the Invention

The invention relates to articles specifically adapted for use in conjunction with computer-based tracking systems.

2. Description of the Related Art

Most sports are played with implements or objects that the players manipulate to achieve desired outcomes. Often, these implements are balls. Balls are used in numerous sports including American football ("football"), soccer, basketball, baseball, tennis, volleyball, and others.

American football is perhaps the most popular major spectator sport in the United States. Each year from late summer through early winter, millions of Americans watch games and their favorite teams. The National Football League (NFL), along with college and high school teams, significantly contribute to American culture. One only needs to examine the Super Bowl and its astounding numbers regarding audience and impact.

Football is a game that many teams only play competitively once in a week. The NFL season is only 16-20 weeks long. Having said that, the game is known for its intensity. In recent years there has been increased focus on injuries that are sustained while practicing or playing football. These injuries harm the players, teams, fans, and society at large. While many companies are addressing safety technologies for the players, perhaps one of the best ways to increase player safety is through computer simulation—especially a Virtual Reality (VR) or Augmented Reality (AR) system.

One of the challenges with existing VR or AR systems for sports games revolves around the ball. Having a fake ball or one that is tethered with wires is less than ideal. Quarterbacks want to practice using a real football so the feel and effects closely parallel reality. Although throwing an actual football in a room or enclosed environment can provide the tactile experience desired by the quarterback, the next challenge is determining where the pass would actually travel. For example, if a quarterback throws a ball and after 10 or 15 feet it hits a net, how can the player and other stakeholders know where that ball would have actually traveled in a real game? This level of detail and data is essential for a realistic training experience.

Until now, most VR simulators have not utilized a real football. Sports Virtual Training Systems, Inc. has created a VR system that utilizes an actual football (which is disclosed in U.S. Patent Application Publication No. 2017/0046967, entitled "VIRTUAL TEAM SPORT TRAINER", which is incorporated herein by reference). One of the challenges has been tracking the actual football with high-definition cameras and sensors. As one skilled in the art would know, tracking a moving object at a high rate of speed during a limited flight path is difficult. Doing this with cameras alone dictates numerous cameras that offer high-definition capabilities. These cameras and the associated installation are expensive and cumbersome. In addition, a larger footprint or practice space is necessary for more cameras to dot the perimeter of the room. Without this array of cameras, the football would need to be modified for tracking. Any modification of the football is potentially perilous though as it can impact the weight, balance, or tactile feel of the ball. These changes are perceptible to trained and training quarterbacks and negatively affect the reality simulation.

SUMMARY OF THE INVENTION

In one aspect a ball includes a ball body and a light system including integrated infrared (IR) light-emitting-diodes (LEDs).

In some embodiments the ball is a football.

In some embodiments the football is adapted for use in conjunction with VR systems.

In some embodiments the ball body includes an inflatable bladder with a covering or skin.

In some embodiments the ball body is of the shape of prolate spheroid.

In some embodiments the light system includes an infrared led control board, a battery, a charging chip, a magnetic charging cable adapter, and the infrared (IR) light-emitting-diodes (LEDs).

In some embodiments the control board is a circuit board and is mounted upon a mounting base secured to an internal surface of a skin of the ball body.

In some embodiments the infrared (IR) light-emitting-diodes (LEDs) are connected to the control board.

In some embodiments the ball further includes a flexible shell including a flat mounting base upon which is at least mounted the control board.

In some embodiments the ball includes a pocketed bladder in which components of the light system are housed.

In some embodiments the infrared (IR) light-emitting-diodes (LEDs) are integrated into or onto skin of the ball body.

In some embodiments the infrared (IR) light-emitting-diodes (LEDs) are mounted on small tabs of flexible circuit material.

In some embodiments the tabs are shaped and dimensioned to be inserted through LED holes in the skin of the ball body.

In some embodiments the ball includes an indicator light and an on/off switch.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 3 is a detailed view of an IR LED.

DESCRIPTION OF THE EMBODIMENTS

Figure 1:
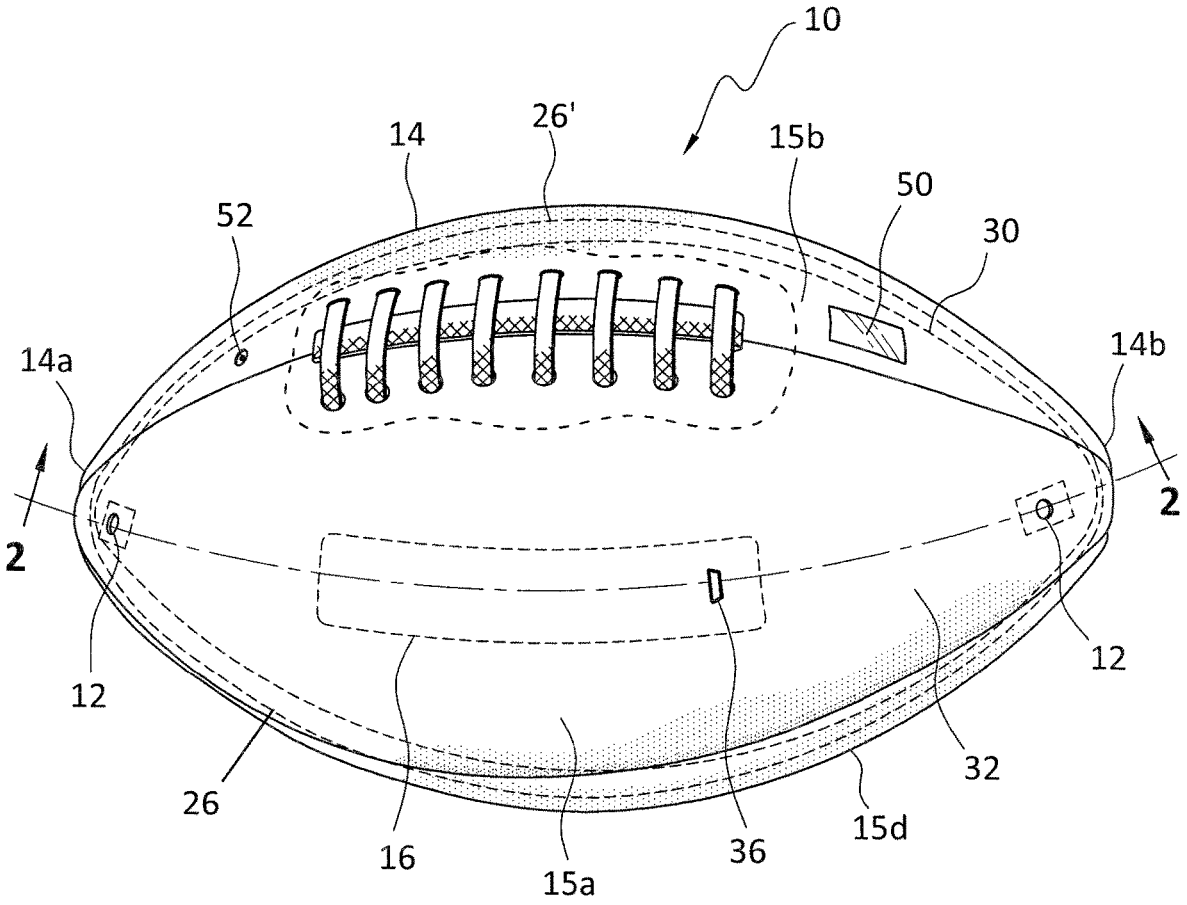
FIG. 1 is a front elevation view of a football in accordance with the present invention.

The detailed embodiments are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to the various figures, a football 10 with integrated infrared (IR) light-emitting-diodes (LEDs) 12 is disclosed. The football 10 is especially designed for use in conjunction with tracking systems that monitor the movement of the football 10 in real-time.

It should be appreciated the disclosed IR LEDs 12 are chosen based on specifications of the IR tracking camera requirements of the tracking system. In accordance with a disclosed embodiment, the OptiTrack™ motion capture tracking system is used and the specifications for the cameras of the OptiTrack™ motion capture tracking system are implemented. However, it is appreciated the cameras can be any type of device which can capture and convert to digital signal to the horizontal and vertical locations of visible LEDs within the view of the IR motion tracking camera. Other consideration in the integration of the IR LEDs 12 into the football body 14 include the specifics of the football structure, chiefly the outer layer thickness. It is appreciated manufacturers and ball styles vary in this regard and IR LED dimensions may require variation. With this in mind, it is contemplated the outer layer of a ball will vary in thickness depending on manufacturer, quality, and intended use. For example, professional footballs have thicker leather outer layers than their faux leather counterparts. This thickness will be used in determining the IR LED size selected for the application. The thicker the material the IR LED must be visible through, the taller the IR LED should be to maintain a flush, or as near as possible, surface of the ball. It is also anticipated that the IR LEDs could be mounted partway through a layer if necessary to ensure placement is as close to flush as possible. Thicker layers can house IR LEDs partway without adjusting the size of the IR LEDs. While this disclosure focuses on American football, it should be understood that the technologies described are readily applicable to other sports.

The IR LEDs 12 of the present football 10 allow for much easier motion tracking of the football 10 after it is airborne. This is due to the fact the IR motion tracking cameras and the associated software of the motion tracking system can focus in on the IR LEDs 12 and their "light trail." This means that fewer cameras are needed, and less advanced technology can be used to create a very realistic simulation. Further, by emitting identifying pulses from the IR LEDs 12 one can also uniquely identify multiple balls within the view of the motion tracking system. The present football 10 is especially adapted for use in conjunction with VR systems such as those disclosed in U.S. Patent Application Publication No. 2017/0046967, entitled "VIRTUAL TEAM SPORT TRAINER", which is previously mentioned and incorporated herein by reference. As such, and as will be appreciated based upon the following disclosure an apparatus, method, and system for actively tracking the motion of a football 10 are disclosed. The disclosure also addresses a system for the construction and large-scale manufacture of the football 10.

Integrating even the smallest IR LEDs 12 into a football 10 requires a great deal of engineering and testing. The following describes a disclosed embodiment. However, and as one skilled in the art would appreciate, other systems, products, and methods may also be used without departing from the spirit of the present invention.

Figure 2:
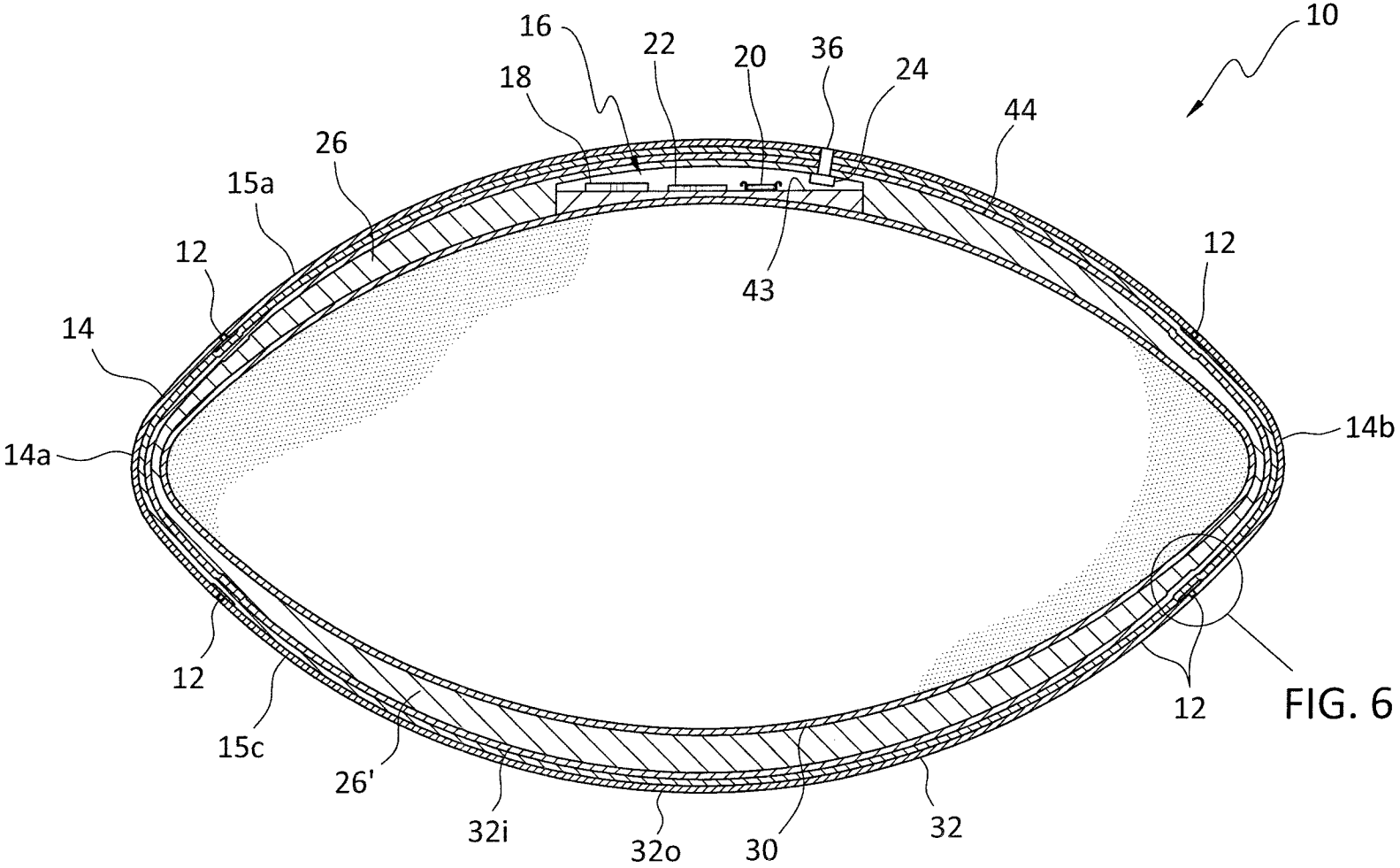
FIG. 2 is a cross sectional view of the football along the line 2-2 in FIG. 1.
Figure 3:
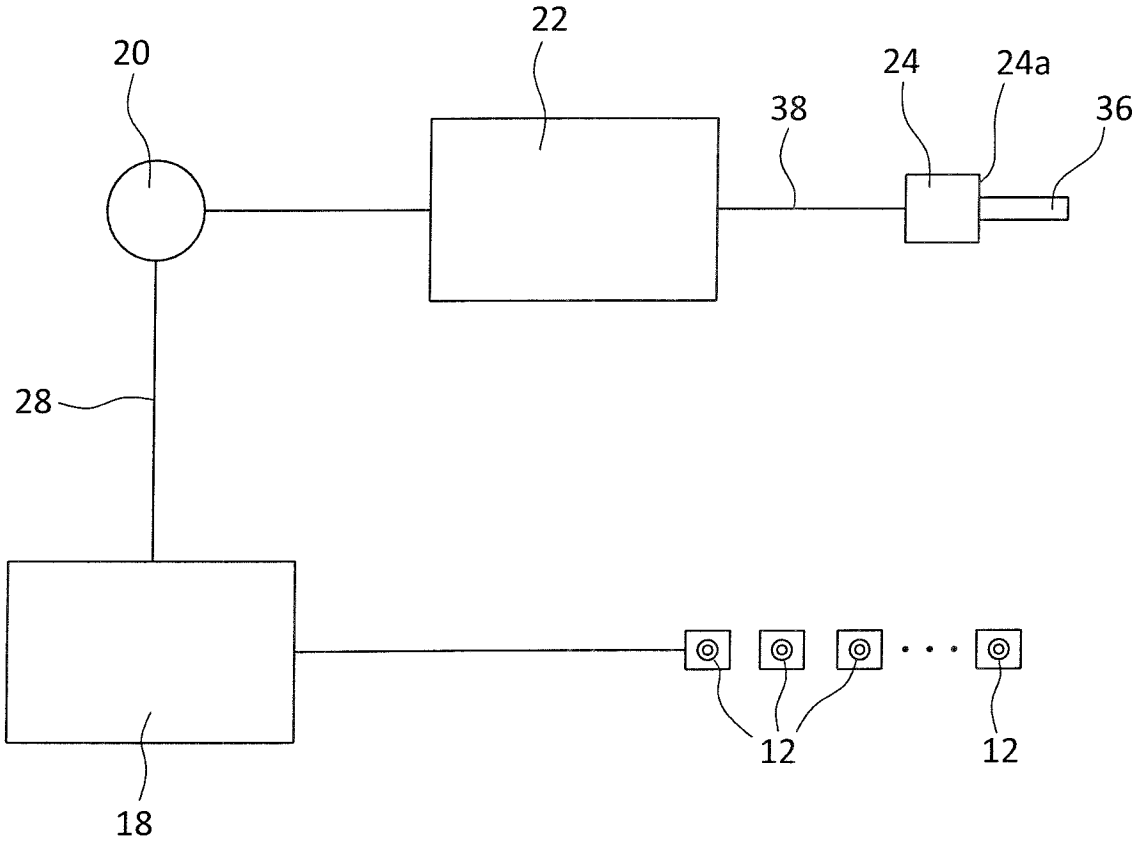
FIG. 3 is a schematic of the light system.

Referring to FIGS. 1 and 2, the actively tracked football 10 comprises the football body 14 and light system 16. The light system 16 includes a variety of electrical components integrated into the football body 14 in a manner providing for functionality in accordance with the present invention, without altering the look, feel or flight of the actively tracked football 10. As will be disclosed below in more detail, the light system 16 includes an infrared led control board 18, a battery 20, a charging chip 22, a magnetic charging cable adapter 24, a set of IR LEDs 12, and wiring 28. As will be appreciated based upon the following disclosure, wiring 28 is required to connect the various parts making up the lighting system 16 of the present actively tracked football 10. In accordance with a disclosed embodiment, the wiring is small gauge (28-32) magnet wire. The wire is thin enough to not present through the skin 32 of the football body 14. The light system 16, and its various components, can also be placed in a format utilizing the multiple separated areas of the ball's interior. These components may also take on varied physical shapes based on the fit inside the ball.

The football body 14 is a conventional football and includes an inflatable bladder 30 with a covering or skin 32, for example, leather, synthetic leather, or other comparable material, secured over the inflatable bladder 30. In accordance with a disclosed embodiment, the skin 32 is composed of three layers, that is, a canvas layer, a padding layer, and an exterior skin layer. The football body 14 is of the shape of prolate spheroid. While a three-layer construction is contemplated in accordance with a disclosed embodiment, each ball manufacturer and ball type will have the possibility of varied layers depending on the ball's use and needs. In accordance with the embodiment disclosed herein, the ball will have at least an outer layer, generally leather or faux leather, an inner canvas layer, and padding layer between the inner layer and the outer layer. However, such a construction should not be considered as limiting as it is appreciated a variety of layering constructions are possible without departing from the spirit of the present invention.

Considering now in detail the elements making up the light system 16 of the present actively tracked football 10, the control board 18 is the OptiTrack™ provided circuit board loaded with their proprietary motion capture software. As with other components of the light system 16, the control board 18 is mounted upon a flat mounting base 43 of a semi-flexible shell 26 that is secured to the internal surface **32*i* of the skin 32 such that the control board 18 is positioned between the skin 32 and the bladder 30**.

The battery 20 is a coin style slim lithium-ion rechargeable battery that is also mounted upon the flat mounting base 43 of the shell 26. The battery 20 is connected to the control board 18 via electrical wiring 28 using known wiring techniques and provides power for the operation of the various electrical components in accordance with the present invention. In accordance with a disclosed embodiment, the battery 20 fits the timing requirements in terms of use, duration, and charging.

While a specific battery is disclosed herein in accordance with the disclosed embodiment, it is appreciated a variety of batteries are known and could be used in conjunction with present invention. For example, it is contemplated smaller chained batteries and/or flexible batteries could be used. Ultimately, a battery is selected that optimizes the weight and/or balance of the actively tracked football 10.

The charging chip 22 is shown below and is also mounted upon the flat mounting base 43 of the shell 26. The charging chip 22 is connected to the battery 20 and regulates charging of the battery 20 using known technologies. In accordance with a disclosed embodiment, the charging chip 22 includes a resistor modified to work with the specific battery 20. As with the other components of the light system 16, the charging chip should be selected to optimize the weight and/or balance of the actively tracked football 10. The flat mounting base may also be constructed in flexible molded form that matches the ball's various curves on one side and the associated components form on the other side. The base material needs to be structurally strong enough to prevent the pressure of the bladder from damaging the circuits when pressing against the curved layers and likewise protect the layers from damage by the edges of the components. Various materials are envisioned—including elastomeric materials such as rubbers, thermoplastics, and foams.

Ideally, the charging chip 22 is shaped and dimensioned with a form fitting minimalist design. While the disclosed charging chip 22 is a traditional version, the charging chip 22 may be constructed such that it is flexible or formed to fit inside the football body 14 while minimizing the materials and weight.

The magnetic charging cable adapter 24 is shown in FIG. 2. The magnetic charging cable adapter 24 is connected to the charging chip 22 and includes an input end 24*a* shaped and dimensioned for attachment to an external charging cable, and ultimately a power source.

The magnetic charging cable adapter 24 is similar to those used in conjunction with cell phones. As such, it includes a magnetically active port 36 and a wire 38 extending between the port 36 and the charging chip 22. In accordance with an alternate embodiment, it is contemplated the magnetic charging cable adapter could be manufactured with similar considerations to the LED tab or LED circle design (as discussed below). In addition, it is appreciated that wireless charging via near field or magnetic field systems, similar to those used in cellphones, could also be implemented. Wireless charging would remove the requirement for an external connection as a source of power. As with all of the components of the lighting system 16 of the present actively tracked football 10, weight is a primary consideration as the actively tracked football 10 should ultimately resemble the shape, weight, and feel of a traditional football so that a user throws and handles the actively tracked football 10 in a conventional manner without changing anything about how the actively tracked football 10 is handled and thrown. The port 36 of the charging cable adapter 24 is centered and flush on a panel 15*a* of the football body 14 (not the panel that has the valve for bladder).

Figure 4:
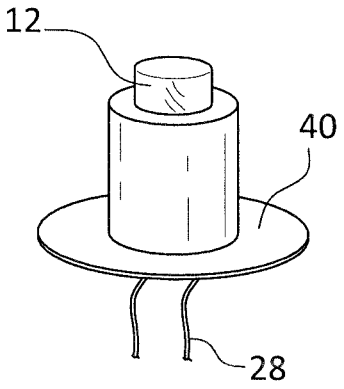
FIG. 4 is a perspective view of the IR LED.
Figure 5:
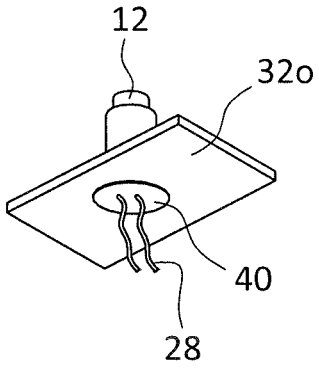
FIG. 5 is a bottom perspective view of the IR LED and tab secured to the skin of the football.
Figure 6:
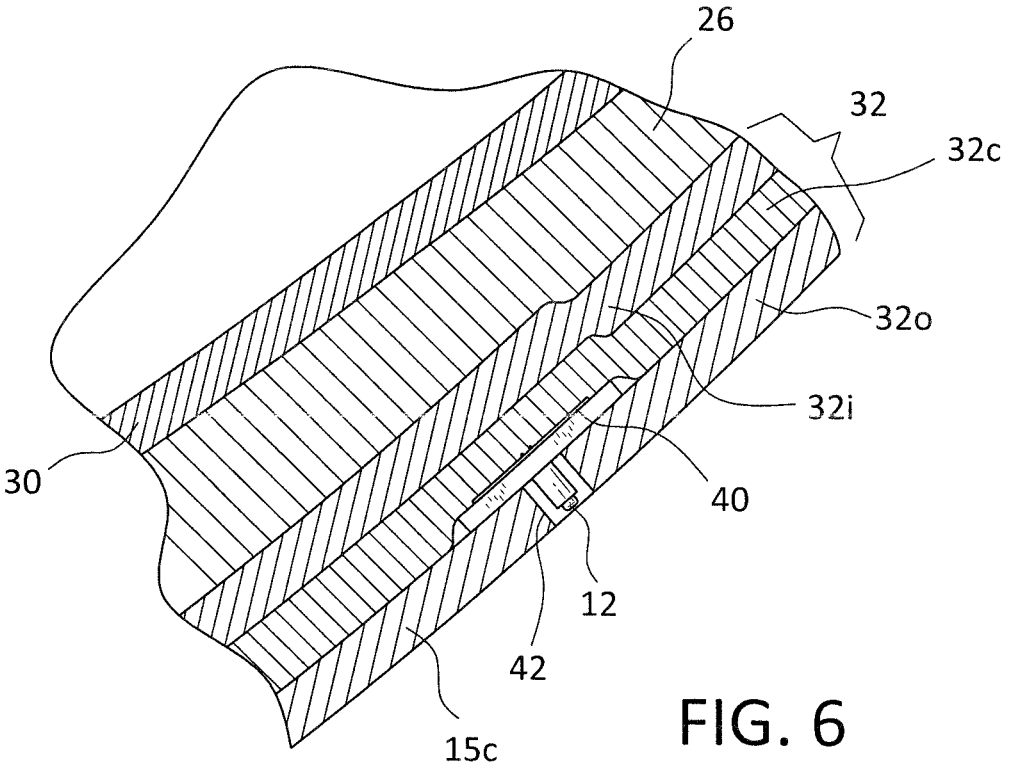
FIG. 6 is a detailed cross-sectional view along the section "6" in FIG. 2 showing an IR LED secured to the skin of the football skin.

IR LEDs 12 in accordance with a disclosed embodiment are shown in detail with reference to FIGS. 4, 5 and 6. As those skilled in the art appreciate, IR LEDs are light emitting diodes that, rather than emitting visible light, emit light in the invisible IR wavelengths. As such, and as discussed above, the incorporation of the IR LEDs 12 into the actively tracked football 10 of the present invention does not materially alter the look or feel of the actively tracked football 10 when compared to a conventional football.

The IR LEDs 12 are connected to the control board 18 via electrical wiring 28. The IR LEDs 12 are integrated into or onto the skin 32 of the football body 14. In accordance with a disclosed embodiment, the pattern is symmetrical, and the IR LED 12 are applied two (2) per panel 15*a-d*, each being 1.5-2 inches from the respective tips 14*a*, 14*b* of the football body 14 and centered laterally on the panels 15*a-d*. Non-symmetrical patterns are also possible as long as the cameras have effective visibility. For example, a ring of LEDs may be possible.

There are a total of 8 IR LEDs 12 integrated into the football body 14. More IR LEDs 12 may be used, but it is appreciated that while the increase in the number of IR LEDs 12 would increase accuracy, the increase in the number of IR LEDs 12 would also likely result in weight and balance issues and would necessitate a more robust control board. The cameras used in conjunction with the motion tracking system require a minimum of 3-4 visible LEDs. As such, and accounting for ball spin, 8 IR LEDs 12 are required to maintain a visible set of 4.

In accordance with a disclosed embodiment, the IR LEDs 12 are mounted individually on small tabs 40 of flexible circuit material (for example, PYRALUX® Copper Kapton Laminate (that is, coated and laminated flexible composites for use in printed circuitry). FIG. 5 shows IR LEDs 12 soldered to a copper pattern etched from the small tabs 40 of the PYRALUX® flexible circuit material.

The tabs 40 are as wide as the IR LEDs 12 and are designed to be inserted through LED holes 42 in the skin 32 of the football body 14 for placement of the IR LEDs 12 where the tabs 40 can open and serve as anchoring tabs to retain the IR LEDs 12 in place; much like some known drywall anchors. In accordance with a disclosed embodiment, the LEDs are 0.8 mm Height Flat Top Infrared LED HIR19-21C/L11/TR8, manufactured by EVERLIGHT. Generally, these LEDs are 0.8 millimeters in width, 1.6 millimeters in length, 0.8 millimeters in height also, within a variance of plus/minus 0.2 millimeters for height and length. As to the tabs, they are based on the pad dimensions with additional traces and pads to allow for wiring. The tabs should be small enough to fit the hole but long enough to retain themselves. They are as wide as the LED is long, 1.6 mm, and approximately 1-centimeter length.

The tabs 40 have minimal copper tracing but enough to securely solder the IR LEDs 12 in place on the respective tabs 40. The wiring 28 connecting the tabs 40 and the IR LEDs 12 to the control board 18 is attached and either twisted around the bottom of the tab 40 or sent through holes in the tab 40 so that it is on the underside of the tab 40. The wire is then sewn through the layers of the skin 32 of the deflated football body 14.

In practice, small holes are drilled through the outer layer 32*o* (of three layers) of the skin 32. The IR LEDs 12 are soldered to tabs 40 of PYRALUX®. A needle is strung on a piece of wire and the ends of that wire are soldered to the ends of the tab 40. The needle is sent through an LED hole 42 and the inner layers of the deflated football body 14. The tab 40 is then folded and fed into the LED hole 42 where it unfolds seating the IR LEDs 12 in the desired position between the outer layer 32*o* and the central layer 32*c* of the skin 32. The wire is then cut in the middle and the needle is removed; this is repeated for all IR LEDs 12. IR LED 12 testing for polarity is done when the wire is attached to connectors to work with the OptiTrack™ controller board 18 (4 LEDs per connector) and attached, through the shell wire holes, to the controller board 18. All wires are worked on through the open lace holes with the bladder 30 in place but deflated. The process regarding modifying an existing ball requires simply to measure the locations and drill, carefully, through the outer layer of the inflated ball. This could be done using a stencil to determine locations for LEDs but is otherwise the same.

In accordance with an alternate embodiment, the IR LEDs 12 is installed during the football body manufacturing process, in which case the tabs do not need to fit through the holes in the skin. Rather the tabs, with the IR LEDs mounted thereon, could be circular and secured with adhesive during the manufacture of the football body. Other consideration in the integration of the IR LEDs into the football body include the specifics of the football structure, chiefly the outer layer thickness. It is appreciated manufacturers and ball styles vary in this regard and thus LED dimensions may require variation.

In accordance with another embodiment, copper traces on extremely light plastic are used as an additional layer within the football body. These plastic sheets match the shape of each panel of the football body and have preplaced copper traces (zip lock plastic and copper tape for prototyping). The LEDs are in place on the skin. The layers of the skin are disassembled and the plastic sheets with copper tracings are added to the layering making up the skin of the football body. The panels are then assembled, including connections for the copper traces to the IR LEDs and control board. As a result, all circuits of the present football could exist on a set of linked highly flexible panels inside the skin of the football body 14 with the IR LEDs on the outward facing side of the skin of the football body and the others on the inward side facing the padded layer. While tabs could still be used in conjunction with such an embodiment, with appropriate caution the copper traces on the soft plastic can be soldered to, before or after, application to the plastic. The pre-application option is the least likely to damage the plastic. It is also technically possible to apply the traces to the inner surface of the ball itself.

Figure 7:
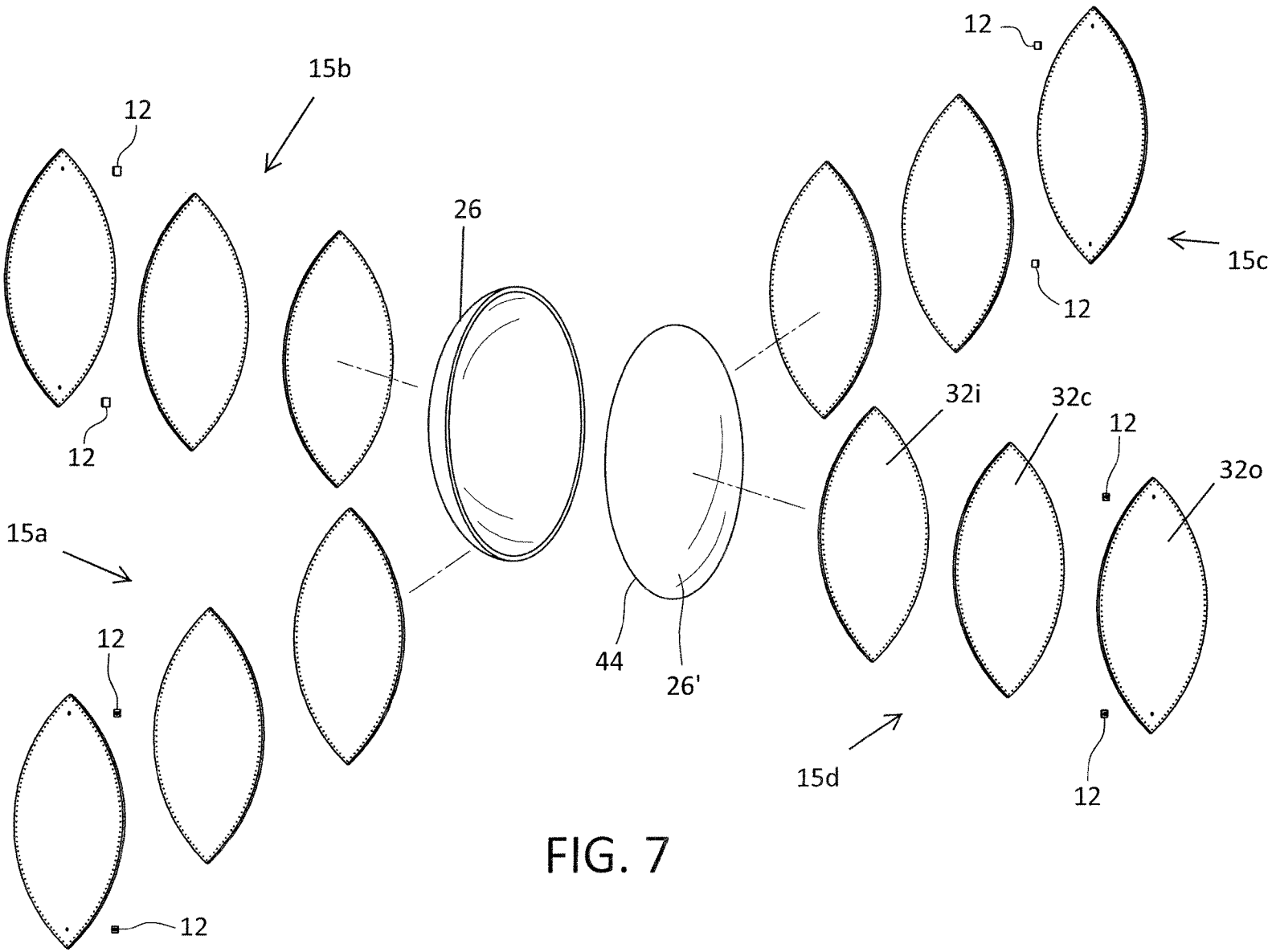
FIG. 7 is an exploded view showing the various layers of the skin and the opposed shells.

Referring to FIGS. 1, 2, and 7, the flexible shell 26 is a turtle shell like structure made from a semi-flexible material. The shell 26 has flex that allows it to expand/contact with the bladder 30 of the football body 14. In accordance with a disclosed embodiment the shell 26 is a 3D printed thermoplastic polyurethane (TPU). The shell 26 is roughly aligned to the inner shape of the football body 14 at full inflation. As briefly discussed above, the shell 26 also has a flat mounting base 43 formed therein for the electrical components it houses (infrared LED control board 18, battery 20, charging chip 22 and wiring 28). This flat mounting base 43 pushes into the shell 26 as the football body 14 is inflated allowing the outer surface 44 of the shell 26 to expand to meet the football body 14 and preventing empty space in the football body 14 as well as flexing to stimulate the football body's natural flex. For the sake of symmetry, a secondary shell 26' is also provided. The secondary shell 26' is substantially identical to the shell 26, but it does not include a mounting base because all of the electrical components are maintained on the flat mounting base 43 of the shell 26.

In accordance with a disclosed embodiment, a single shell is used for all the internal electronic chips. It is, however, contemplated the various electronic chips may be separated into smaller shells to disperse the weight around the football body more evenly. Ideally all circuits would be spread around the football body in a form and dispersion best for balance.

Figure 8:
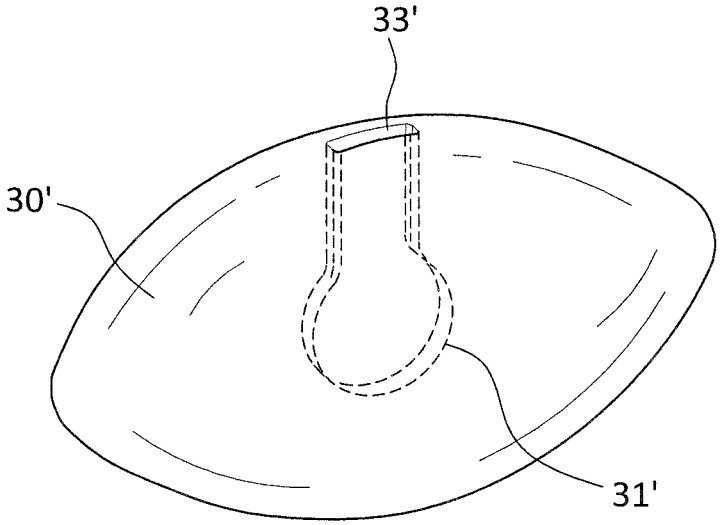
FIG. 8 shows an alternate embodiment for a bladder for use with the football.

In accordance with an alternate embodiment as shown with reference to FIG. 8, a pocketed bladder 30' design is contemplated. Such an embodiment includes a bladder 30' shaped to have a floating pocket 31' balanced at its center and held evenly so it would not bounce around inside. This would have a small access slot 33' that the circuits could be inserted through. The bladder may also be connected on both sides to encourage stability. The ends may remain open on both sides to allow for easier wiring within the football.

The football body 14 also includes indicator light(s) 50 providing the user with information regarding the various ball statuses. In accordance with a disclosed embodiment, the indicator light 50 is a multicolored LED providing status information such as, but not limited to, On, Connecting, Connected, Charging, Battery Low/Med/High. In accordance with a disclosed embodiment the indicator light 50 is placed near the laces where it can be found easily but does not interfere with the use of the actively tracked football 10. The football body 14 further includes an on/off switch 52 and its placement is similar to that of the indicator light(s) 50. The on/off switch 52 is preferably a flush mount switch (such as a reset button style that requires a pen or paperclip to press). Another option is an internally placed magnetic switch, allowing for a magnetic key to turn the ball on and off.

In accordance with yet another alternate embodiment, it is contemplated to add additional sets of IR LEDs within the pattern range previously discussed, allowing for IR LED failure in which case the IR LEDs would automatically transition to the next IR LED. This would prolong the ball's lifespan. The secondary and tertiary IR LEDs would function on the same signal line as the primary but remain inactive unless the IR LEDs ahead of them in line fail. The virtual ball pattern would have to account for this change as the pattern would be slightly different or (less effectively) placement would have to be very close.

In summary, the actively tracked football 10 comprises a port of the charging cable adapter 24 on a panel of the football body 14 and, internally, a single TPU shell 26 protecting the chips and battery 20. Wiring comes out of the shell 26 to the port of the charging cable adapter and to the various IR LEDs 12.

The manufacturing process for the proposed invention is important. The following steps are contemplated in accordance with a disclosed embodiment. A set of holes are cut, stamped, or otherwise made in the outer layer (or such layers as may be necessary) of the skin of the football body. The holes are cut in a manner to ensure as near to identical patterns as possible in a repetitious manufacturing process. The ideal time for this is at the same occasion as the layer is stamped out of the material sheet, generally leather, before any shaping is done. The holes are as small as manageable to accommodate the IR LEDs with minimal loss of layer surface area.

The tabs, as previously described, are installed after the layer is cut; ideally a flexible circle, likely with 2 (two) small expansion slots to accommodate multi-directional flexion. These would have the appropriate IR LEDs soldered in place and an appropriate length of wire soldered at both ends and coming to the back side through holes or over the edge of the tab, or the expansion slots. The wire would have a needle threaded on it for sewing it through the remaining layers.

The assembled tabs are adhered to the inner facing side of the outer layer with the IR LEDs resting in the holes and facing outward. The remaining layers are aligned, and the needle can then be used to thread the wire through at the appropriate spot. These wires are then taped or otherwise secured to the inner layer to keep them out of the way. It is important to note that once the needle is cut from the wire, the wires of each IR LED must remain in their pairs until each IR LED is ready to be attached to its appropriate connection, such connections must be appropriately paired, and polarity does matter. Connections should not be added until after the football body is inverted to its proper orientation, which happens later.

Once all panels have IR LED tabs installed and wires sewn through the inner layers, the football body can be assembled in the same fashion as expected of a standard football. Each panel's layers are sewn together, followed by the 4 panels being sewn to each other, at this point the football body is inside out. The process, again in the standard fashion, then involves inverting the football to have the outer layer facing the outside.

At this point the connections are placed, and the various circuitry with its respective protective housing, or turtle shell, are installed and oriented. This includes the controller board, the battery, the charging chip, as well as any other components that might be required. The placement should be such that the flight of the ball is as near to that of a standard ball as possible. Final stitching of the laces can then be done.

The ball would be significantly easier to build if the LED tabs and charging tab were installed during the actual ball manufacturing process. The solder would need to be of a temperature rating high enough to handle the high heat steaming the ball experiences in manufacturing. Of course, all components could go in prior to final manufacturer lacing of the ball.

Those skilled in the art will appreciate that the various illustrative logical blocks, modules, circuits, and algorithm steps described in connection with the embodiments disclosed herein may be implemented as electronic hardware, computer software running on a specific purpose machine that is programmed to carry out the operations described in this application, or combinations of both. To clearly illustrate this interchangeability of hardware and software, various illustrative components, blocks, modules, circuits, and steps have been described above generally in terms of their functionality. Whether such functionality is implemented as hardware or software depends upon the particular design constraints imposed on the system. Skilled artisans may implement the described functionality in varying ways, but such implementation decisions should not be interpreted as causing a departure from the scope of the exemplary embodiments.

The various illustrative logical blocks, modules, and circuits described in connection with the embodiments disclosed herein, may be implemented or performed with a general or specific purpose processor, or with hardware that carries out these functions, e.g., a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine.

The processor can be part of a computer system that also has an internal bus connecting to cards or other hardware, running based on a system BIOS or equivalent that contains startup and boot software, system memory which provides temporary storage for an operating system, drivers for the hardware and for application programs, disk interface which provides an interface between internal storage device(s) and the other hardware, an external peripheral controller which interfaces to external devices such as a backup storage device, and a network that connects to a hard-wired network cable such as Ethernet or may be a wireless connection such as a RF link running under a wireless protocol such as 802.11. Likewise, external bus may be any of but not limited to hard wired external busses such as IEEE-1394 or USB.

The system can also have a user interface port that communicates with a user interface, and which receives commands entered by a user, and a video output that produces its output via any kind of video output format, e.g., VGA, DVI, HDMI, display port, or any other form. This may include laptop or desktop computers, and may also include portable computers, including cell phones, smartphones, tablets such as the IPAD™ and Android platform tablet, and all other kinds of computers and computing platforms.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, using cloud computing, or in combinations, using tangible computer programming. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non-transitory computer-based instructions. An exemplary storage medium is coupled to the processor such that the processor can read information from, and write information to, the storage medium. In the alternative, the storage medium may be integral to the processor. The processor and the storage medium may reside in reconfigurable logic of any type.

Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes, but is not limited to, compact disc (CD), laser disc, optical disc, digital versatile disc (DVD), floppy disk and Blu-Ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

The computer-based systems described herein may be any kind of computer, either general purpose, or some specific purpose computer such as a workstation. The programs may be written in C, or Java, Brew, or any other programming language. The programs may be resident on a storage medium, e.g., magnetic or optical, e.g., the computer hard drive, a removable disk or media such as a memory stick or SD media, or other removable medium. The programs may also be run over a network, for example, with a server or other machine sending signals to the local machine, which allows the local machine to carry out the operations described herein.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A ball, comprising:

a ball body includes an inflatable bladder, a flexible shell having a mounting base, and a skin, the skin includes an outer layer, an inner layer, and a central layer between the inner layer and the outer layer; and a light system including integrated infrared (IR) light-emitting-diodes (LEDs) mounted on tabs of flexible circuit material, an infrared light-emitting-diode control board, a battery, a charging chip, and a charging cable adapter, wherein the infrared light-emitting-diode control board is positioned on the mounting base of the flexible shell;

wherein the outer layer of the skin of the ball body includes LED holes and the tabs are shaped and dimensioned to be inserted through the LED holes in the skin of the ball body such that the infrared (IR) light-emitting-diodes (LEDs) are positioned between the outer layer and the central layer of the skin.

2. The ball according to claim 1, wherein the ball is a football.

3. The ball according to claim 2, wherein the football is adapted for use in conjunction with VR systems.

4. The ball according to claim 1, wherein the ball is adapted for use in conjunction with VR systems.

5. The ball according to claim 1, wherein the ball body is of the shape of prolate spheroid.

6. The ball according to claim 1, wherein the control board is a circuit board and is mounted upon the mounting base secured to an internal surface of the skin of the ball body.

7. The ball according to claim 1, wherein the infrared (IR) light-emitting-diodes (LEDs) are connected to the control board via electrical wiring.

8. The ball according to claim 1, wherein the mounting base is a flat mounting base.

9. The ball according to claim 1, further including a pocketed bladder in which components of the light system are housed.

10. The ball according to claim 1, wherein infrared (IR) light-emitting-diodes (LEDs) are integrated into or onto skin of the ball body.

11. The ball according to claim 10, wherein the infrared (IR) light-emitting-diodes (LEDs) are mounted on small tabs of flexible circuit material.

12. The ball according to claim 1, further including an indicator light and an on/off switch.

13. The ball according to claim 6, wherein the infrared (IR) light-emitting-diodes (LEDs) are connected to the control board via electrical wiring.

14. The ball according to claim 13, wherein the mounting base is a flat mounting base.

15. The ball according to claim 14, wherein the infrared (IR) light-emitting-diodes (LEDs) are integrated into or onto the skin of the ball body.

16. The ball according to claim 15, wherein the infrared (IR) light-emitting-diodes (LEDs) are mounted on small tabs of flexible circuit material.

17. The ball according to claim 16, further including an indicator light and an on/off switch.

* * * * *